US009683760B2

(12) United States Patent
Sun et al.

(10) Patent No.: US 9,683,760 B2
(45) Date of Patent: Jun. 20, 2017

(54) OUTDOOR UNIT OF AIR-CONDITIONER, TWO-PIPE AIR-CONDITIONING SYSTEM AND THREE-PIPE AIR-CONDITIONING SYSTEM HAVING THE SAME

(71) Applicant: GD Midea Heating & Ventilating Equipment Co., Guangdong (CN)

(72) Inventors: Xianjin Sun, Guangdong (CN); Meibing Xiong, Guangdong (CN); Xihua Ma, Guangdong (CN); Zhengxing Wang, Guangdong (CN)

(73) Assignee: GD Midea Heating & Ventilating Equip. Co., Ltd., Guangdong (CN)

( * ) Notice: Subject to any disclaimer, the term of this patent is extended or adjusted under 35 U.S.C. 154(b) by 340 days.

(21) Appl. No.: 14/476,832

(22) Filed: Sep. 4, 2014

(65) Prior Publication Data

US 2015/0068241 A1 Mar. 12, 2015

(30) Foreign Application Priority Data

Sep. 10, 2013 (CN) ..... 2013 2 0561691 U

(51) Int. Cl.
*F25B 13/00* (2006.01)
*F25B 41/04* (2006.01)

(52) U.S. Cl.
CPC ..... *F25B 13/00* (2013.01); *F25B 41/04* (2013.01); *F25B 2313/007* (2013.01); *F25B 2313/0253* (2013.01); *F25B 2313/02331* (2013.01); *F25B 2313/02334* (2013.01); *F25B 2313/02531* (2013.01); *F25B 2313/02533* (2013.01); *F25B 2313/02742* (2013.01); *F25B 2313/02743* (2013.01)

(58) Field of Classification Search
CPC combination set(s) only.
See application file for complete search history.

(56) References Cited

U.S. PATENT DOCUMENTS

2011/0048054 A1* 3/2011 Sekine ..... F25B 13/00 62/324.6

* cited by examiner

*Primary Examiner* — Lauren Crane
(74) *Attorney, Agent, or Firm* — Maginot, Moore & Beck, LLP

(57) ABSTRACT

An outdoor unit of an air-conditioner and two-pipe and three-pipe air-conditioning systems having the same are provided. The outdoor unit includes a compressor defining an outlet and an inlet; a first four-way valve defining a first valve communicated with the outlet, second and third ports communicated with the inlet; a second four-way valve defining second and third ports communicated with the inlet; an outdoor heat exchanger defining a first refrigerant valve Communicated with the fourth port of the first four-way valve; a first gas pipe defining a first end connected with the second and third ports of the first and second four-way valves and, the inlet; a second gas pipe defining a first end connected with the fourth port of the second four-way valve; a third gas pipe defining a first end connected with the outlet and a second end connected with the first port of the second four-way valve.

20 Claims, 13 Drawing Sheets

OUTDOOR UNIT OF AIR-CONDITIONER, TWO-PIPE AIR-CONDITIONING SYSTEM AND THREE-PIPE AIR-CONDITIONING SYSTEM HAVING THE SAME

CROSS REFERENCE TO RELATED APPLICATION

This application claims priority and benefits of Chinese Patent Application No. 201320561691.3, filed with State Intellectual Property Office on Sep. 10, 2013, the entire content of which is incorporated herein by reference.

FIELD

Embodiments of the present disclosure generally relate to a field of an air-conditioner, and more particularly, to an outdoor unit of an air-conditioner, a two-pipe air-conditioning system and a three-pipe air-conditioning system having the same.

BACKGROUND

With a two-pipe air-conditioning system in the related art, the operation modes of the indoor units include a refrigerating mode (namely, all of the indoor units work in the refrigerating mode) and a heating mode (namely, all of the indoor units work in the heating mode). With a three-pipe air-conditioning system in the related art, the operation modes of the indoor units include a refrigerating mode, a heating mode and a mixed mode (namely, a part of the indoor units may work in the heating mode and the other part of the indoor units may work in the refrigerating mode simultaneously).

In the related art, the outdoor units used in the two-pipe air-conditioning system or the three-pipe air-conditioning system respectively have different structures, and cannot be interchangeable, i.e. the outdoor unit used in the two-pipe air-conditioning system cannot be adopted in the three-pipe air-conditioning system, on the contrary, the outdoor unit used in the three-pipe air-conditioning system cannot be adopted in the two-pipe air-conditioning system either.

In order to meet assembling requirements of the two-pipe air-conditioning system and the three-pipe air-conditioning system, manufacturers shall manufacture two types of outdoor units having different structures, prepare different production lines and equipment for the two types of outdoor units, and design different production planning, thus increasing the manufacturing cost of the air-conditioner and affecting subsequent maintenance.

SUMMARY

Embodiments of the present disclosure seek to solve at least one of the problems existing in the related art to at least some extent.

Embodiments of a first broad aspect of the present disclosure provide an outdoor unit of an air-conditioner adapted to be used in a two-pipe air-conditioning system or a three-pipe air-conditioning system, thus improving the applicability of the outdoor unit.

Embodiments of a second broad aspect of the present disclosure provide a two-pipe air-conditioning system having the outdoor unit.

Embodiments of a third broad aspect of the present disclosure provide a three-pipe air-conditioning system having the outdoor unit.

Embodiment of the present disclosure provide an outdoor unit of an air-conditioner, including: a compressor defining an outlet and an inlet; a first four-way valve defining first to fourth ports, the first port of the first four-way valve being communicated with the outlet of the compressor, the second and third ports of the first four-way valve being communicated with the inlet of the compressor; a second four-way valve defining first to fourth ports, the second and third ports of the second four-way valve being communicated with the inlet of the compressor; an outdoor heat exchanger defining first and second refrigerant ports, the first refrigerant port being communicated with the fourth port of the first four-way valve; a liquid pipe defining a first end and a second end, the first end of the liquid pipe being connected with the second refrigerant port of the outdoor heat exchanger; a first gas pipe defining a first end and a second end, the first end of the first gas pipe being connected with the second and third ports of the first four-way valve, the second and third ports of the second four-way valve, and the inlet of the compressor; a second gas pipe defining a first end and a second end, the first end of the second gas pipe being connected with the fourth port of the second four-way valve; a third gas pipe defining a first end and a second end, the first end of the third gas pipe being connected with the outlet of the compressor, and the second end of the third gas pipe being connected with the first port of the second four-way valve; first and second control valves connected with each other in parallel and disposed on the second gas pipe.

In some embodiments, the first port of the first four-way valve is communicated with the outlet of the compressor via a first communicating pipe, and the first end of the third gas pipe is connected with the first communicating pipe, in which the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

In some embodiments, the second port of the first four-way valve is connected with the second communicating pipe via a first capillary, and the second port of the second four-way valve is connected with the third communicating pipe via a second capillary.

In some embodiments, the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve. In some embodiments, the outdoor unit further includes an expansion valve connected between the second refrigerant port of the outdoor heat exchanger and the first end of the liquid pipe.

In some embodiments, there are a plurality of the outdoor heat exchangers, and the number of the outdoor heat exchangers is equal to that of the first four-way valve, and the first ports of the first four-way valves are connected with the outlet of the compressor and the first end of the third gas pipe respectively, and the first end of the first gas pipe is connected with the second and third ports of the first four-way valves, and the fourth ports of the first four-way valves are connected with the first refrigerant ports of the outdoor heat exchangers in a one-to-one correspondence manner, and the first end of the liquid pipe is connected with the second refrigerant ports of the outdoor heat exchangers.

In some embodiments, the outdoor unit further includes a first switch disposed at the second end of the liquid pipe; a second switch disposed at the second end of the second gas pipe; a third switch disposed at the second end of the first gas pipe.

In some embodiments, the first switch and the third switch is any of a cut-off valve or an electromagnetic valve.

Embodiments of the present disclosure provide a two-pipe air-conditioning system, including: an indoor unit assembly including at least one indoor unit defining first and second refrigerant ports; and an outdoor unit, in which the outdoor unit includes: a compressor defining an outlet and an inlet; a first four-way valve defining first to fourth ports, the first port of the first four-way valve being communicated with the outlet of the compressor, the second and third ports of the first four-way valve being communicated with the inlet of the compressor; a second four-way valve defining first to fourth ports, the second and third ports of the second four-way valve being communicated with the inlet of the compressor; an outdoor heat exchanger defining first and second refrigerant ports, the first refrigerant port being communicated with the fourth port of the first four-way valve; a liquid pipe defining a first end and a second end, the first end of the liquid pipe being connected with the second refrigerant port of the outdoor heat exchanger, and the second end of the liquid pipe being connected with the first refrigerant port of the indoor unit; a first gas pipe defining a first end and a second end, the first end of the first gas pipe being connected with the second and third ports of the first four-way valve, the second and third ports of the second four-way valve, and the inlet of the compressor; a second gas pipe defining a first end and a second end, the first end of the second gas pipe being connected with the fourth port of the second four-way valve, and the second end of the second gas pipe being connected with the second refrigerant port of the indoor unit; a third gas pipe defining a first end and a second end, the first end of the third gas pipe being connected with the outlet of the compressor, and the second end of the third gas pipe being connected with the first port of the second four-way valve; first and second control valves connected with each other in parallel and disposed on the second gas pipe. In some embodiments, the first port of the first four-way valve is communicated with the outlet of the compressor via a first communicating pipe, and the first end of the third gas pipe is connected with the first communicating pipe, in which the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

In some embodiments, there are a plurality of the outdoor heat exchangers, and the number of the outdoor heat exchangers is equal to that of the first four-way valve, and the first ports of the first four-way valves are connected with the outlet of the compressor and the first end of the third gas pipe respectively, and the first end of the first gas pipe is connected with the second and third ports of the first four-way valves, and the fourth ports of the first four-way valves are connected with the first refrigerant ports of the outdoor heat exchangers in a one-to-one correspondence manner, and the first end of the liquid pipe is connected with the second refrigerant ports of the outdoor heat exchangers.

In some embodiments, the outdoor unit further includes: a first switch disposed at the second end of the liquid pipe; a second switch disposed at the second end of the second gas pipe; a third switch disposed at the second end of the first gas pipe.

In some embodiments, each of the first to the third switches is any one of a cut-off valve and an electromagnetic valve, in which the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve.

Embodiments of the present disclosure provide a three-pipe air-conditioning system, including: a first indoor unit assembly including at least one first indoor unit defining first and second refrigerant ports; a second indoor unit assembly including at least one second indoor unit defining first and second refrigerant ports; an outdoor unit; and a refrigerant switching device connected with the second refrigerant ports of the first and second indoor units and the second end of the first gas pipe, and configured to switch a flowing direction of the refrigerant, in which an outdoor unit includes: a compressor defining an outlet and an inlet; a first four-way valve defining first to fourth ports, the first port of the first four-way valve being communicated with the outlet of the compressor, the second and third ports of the first four-way valve being communicated with the inlet of the compressor; a second four-way valve defining first to fourth ports, the second and third ports of the second four-way valve being communicated with the inlet of the compressor; an outdoor heat exchanger defining first and second refrigerant ports, the first refrigerant port being communicated with the fourth port of the first four-way valve; a liquid pipe defining a first end and a second end, the first end of the liquid pipe being connected with the second refrigerant port of the outdoor heat exchanger, and the second end of the liquid pipe being connected with the first refrigerant ports of the first and second indoor units; a first gas pipe defining a first end and a second end, the first end of the first gas pipe being connected with the second and third ports of the first four-way valve, the second and third ports of the second four-way valve, and the inlet of the compressor; a second gas pipe defining a first end and a second end, the first end of the second gas pipe being connected with the fourth port of the second four-way valve; a third gas pipe defining a first end and a second end, the first end of the third gas pipe being connected with the outlet of the compressor, and the second end of the third gas pipe being connected with the first port of the second four-way valve; first and second control valves connected with each other in parallel and disposed on the second gas pipe, a refrigerant switching device connected with the second refrigerant ports of the first and second indoor units and the second end of the first gas pipe, and configured to switch a flowing direction of the refrigerant.

In some embodiments, the refrigerant switching device includes a first direction switching member and a second direction switching member, each of the first and second direction switching members has first to third ports, in which the first port of the first direction switching member is connected with the second refrigerant port of the first indoor unit, the first port of the second direction switching member is connected with the second refrigerant port of the second indoor unit, and the second ports of the first and second direction switching members are connected in parallel and then connected with the second end of the first gas pipe, and the third ports of the first and second direction switching members are connected in parallel and then connected with the second end of the second gas pipe.

In some embodiments, each of the first and second direction switching members includes: a first valve connected between the first and second ports of each of first and second direction switching members; a second valve connected in parallel with the first valve; a third valve connected between the first and third ports of each of first and second direction switching members; a fourth valve connected in parallel with the third valve.

In some embodiments, each of the first to fourth valves is any one of an electronic expansion valve, a four-way valve and an electromagnetic valve.

In some embodiments, the first port of the first four-way valve is connected with the outlet of the compressor via a first communicating pipe, the first end of the third gas pipe is connected with the first communicating pipe, in which the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

In some embodiments, there are a plurality of the outdoor heat exchangers, and the number of the outdoor heat exchangers is equal to that of the first four-way valve, and the first ports of the first four-way valves are connected with the outlet of the compressor and the first end of the third gas pipe respectively, and the first end of the first gas pipe is connected with the second ports and the third ports of the plurality of first four-way valves, and the fourth ports of the first four-way valves are connected with the first refrigerant ports of the plurality of outdoor heat exchangers in a one to one correspondence manner, and the first end of the liquid pipe is connected with the second refrigerant ports of the outdoor heat exchangers.

In some embodiments, the outdoor unit further includes: a first switch disposed at the second end of the liquid pipe; a second switch disposed at the second end of the second gas pipe; a third switch disposed at the second end of the first gas pipe, in which each of the first to third switches is one of a cut-off valve and an electromagnetic valve, and the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve.

The outdoor unit of the air-conditioner according to embodiments of the present disclosure can be used in the two-pipe air-conditioning system or the three-pipe air-conditioning system, and there is no need to manufacture different outdoor units for different air-conditioning systems, thus improving the applicability of the outdoor unit and reducing the manufacturing cost of the air conditioner.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
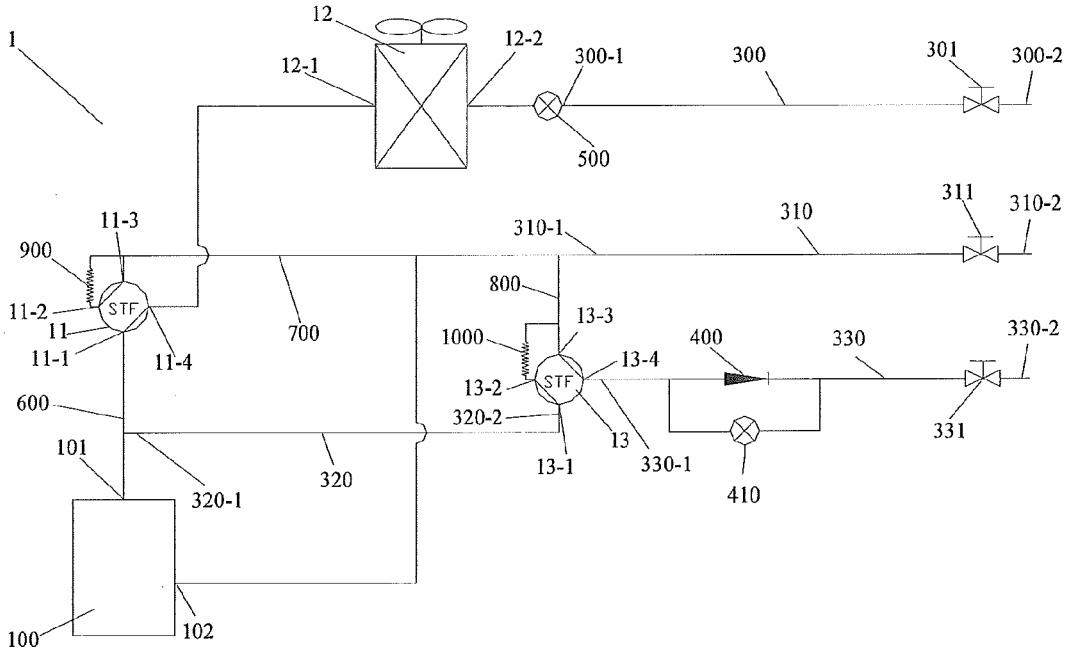
FIG. 1 is a schematic view of an outdoor unit of an air-conditioner according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom", "inner", "outer", "clockwise", "anticlockwise" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or interreaction between two elements. These having ordinary skills in the art should understand the specific meanings in the present disclosure according to specific situations.

An outdoor unit of an air-conditioner according to embodiments of the present disclosure will be described in the following with reference to FIGS. 1 and 2.

The outdoor unit 1 adapted to be used in a two-pipe air-conditioning system or a three-pipe air-conditioning system, includes a compressor 100, a first four-way valve 11, a second four-way valve 13, an outdoor heat exchanger 12, a liquid pipe 300, a first gas pipe 310, a second gas pipe 330, a third gas pipe 320, a first control valve 400 and a second control valve 410.

Specifically, as shown in FIG. 1, the compressor 100 has an outlet 101 and an inlet 102. The first four-way valve 11 has first to fourth ports 11-1 to 11-4, and the first port 11-1 of the first four-way valve 11 is communicated with the outlet 101 of the compressor 100, and the second port 11-2 and the third port 11-3 of the first four-way valve 11 are communicated with the inlet 102 of the compressor 100. The second four-way valve 13 has first to fourth ports 13-1 to 13-4, and the second port 13-2 and the third port 13-3 of the second four-way valve 13 are communicated with the inlet 102 of the compressor 100.

The outdoor heat exchanger 12 has a first refrigerant port 12-1 and a second refrigerant port 12-2, and the first refrigerant port 12-1 is communicated with the fourth port 11-4 of the first four-way valve 11. The liquid pipe 300 has a first end 300-1 and a second end 300-2, and the first end 300-1 of the liquid pipe 300 is connected with the second refrigerant port 12-2 of the outdoor heat exchanger 12.

The first gas pipe 310, as a low pressure pipe, has a first end 310-1 and a second end 310-2. The first end 310-1 of the first gas pipe 310 is connected with the second port 11-2 and the third port 11-3 of the first four-way valve 11, the second port 13-2 and the third port 13-3 of the second four-way valve 13, and the inlet 102 of the compressor 100 respectively. The second gas pipe 330, as a medium pressure pipe, has a first end 330-1 and a second end 330-2, and the first end 330-1 of the second gas pipe 330 is connected with the fourth port 13-4 of the second four-way valve 13. The third gas pipe 320, as a high pressure pipe, has a first end 320-1 and a second end 320-2. The first end 320-1 of the third gas pipe 320 is connected with the outlet 101 of the compressor 100, and the second end 320-2 of the third gas pipe 320 is connected with the first port 13-1 of the second four-way valve 13.

The first control valve 400 and the second control valve 410 are connected with each other in parallel and disposed on the second gas pipe 330, namely, both ends of the first control valve 400 and both ends of the second control valve 410 are connected with the second gas pipe 330. The first control valve 400 is a check valve which allows flowing through of a refrigerant along a direction from the first end 330-1 of the second gas pipe 330 to the second end 330-2 of the second gas pipe 330, and the second control valve 410 is any one of a ball valve, an electromagnetic valve, an electronic expansion valve and a cut-off valve.

When the refrigerant is needed to flow within the second gas pipe 330 along a direction from the second end 330-2 to the first end 330-1 of the second gas pipe 330, the second control valve 410 shall be switched on, i.e., the second control valve 410 is ON, such that the refrigerant can flow along the direction from the second end 330-2 to the first end 330-1 via the second control valve 410, so that the refrigerant bypasses the check valve.

In an embodiment of the present disclosure, as shown in FIG. 1, the first port 11-1 of the first four-way valve 11 is communicated with the outlet 101 of the compressor 100 via a first communicating pipe 600, and the first end 320-1 of the third gas pipe 320 is connected with the first communicating pipe 600. The first end 310-1 of the first gas pipe 310 is connected with the second port 11-2 and the third port 11-3 of the first four-way valve 11 via a second communicating pipe 700, and the third port 13-3 of the second four-way valve 13 is connected with the first end 310-1 of the first gas pipe 310 via a third communicating pipe 800, and the second port 13-2 of the second four-way valve 13 is connected with the third communicating pipe 800.

The second port 11-2 of the first four-way valve 11 is connected with the second communicating pipe 700 via a first capillary 900, and the second port 13-2 of the second four-way valve 13 is connected with the third communicating pipe 800 via a second capillary 1000.

In some embodiments, the outdoor unit 1 further includes an expansion valve 500 connected between the second refrigerant port 12-2 of the outdoor heat exchanger 12 and the first end 300-1 of the liquid pipe 300.

The first four-way valve 11 can connect the outlet 101 with the outdoor heat exchanger 12 or connect the inlet 102 with the outdoor heat exchanger 12 by controlling internal connections among the first to fourth ports 11-1 to 11-4 of the first four-way valve 11, i.e., the first four-way valve 11 can be switched from connecting the outlet 101 with the outdoor heat exchanger 12 to connecting the inlet 102 with the outdoor heat exchanger 12. Similarly, the second four-way valve 13 can be switched from connecting the first gas pipe 310 with the second gas pipe 330 to connecting the third gas pipe 320 with the second gas pipe 330 by controlling internal connections among the first to fourth ports 13-1 to 13-4 of the second four-way valve 13.

For example, when the first four-way valve 11 is ON, the outdoor heat exchanger 12 is communicated with the inlet 102; when the first four-way valve 11 is OFF, the outdoor heat exchanger 12 is communicated with the outlet 101. When the second four-way valve 13 is ON, the second gas pipe 330 is communicated with the first gas pipe 310; when the second four-way valve is OFF, the second gas pipe 330 is communicated with the third gas pipe 320. So that the first four-way valve 11 or the second four-way valve 13 always allow the refrigerant to flow along one of the two flowing paths.

In some embodiments, the outdoor unit 1 further includes a first switch 301 disposed at the second end 300-2 of the liquid pipe 300; a second switch 331 disposed at the second end 330-2 of the second gas pipe 330; a third switch 311 disposed at the second end 310-2 of the first gas pipe 310. The first switch 301, the second switch 331 and the third switch 311 can turn on or off the corresponding pipes respectively, and may be cut-off valves.

In an embodiment of the present disclosure as shown in FIG. 1, the number of the outdoor heat exchanger 12 is one, correspondingly, the number of the first four-way valve 11 is one.

In an embodiment, the outdoor unit may include a plurality of outdoor heat exchangers 12 connected with one another in parallel, the number of the first four-way valve 11 is equal to that of the outdoor heat exchanger 12, and each first four-way valve 11 is connected with a corresponding outdoor heat exchanger 12.

Figure 2:
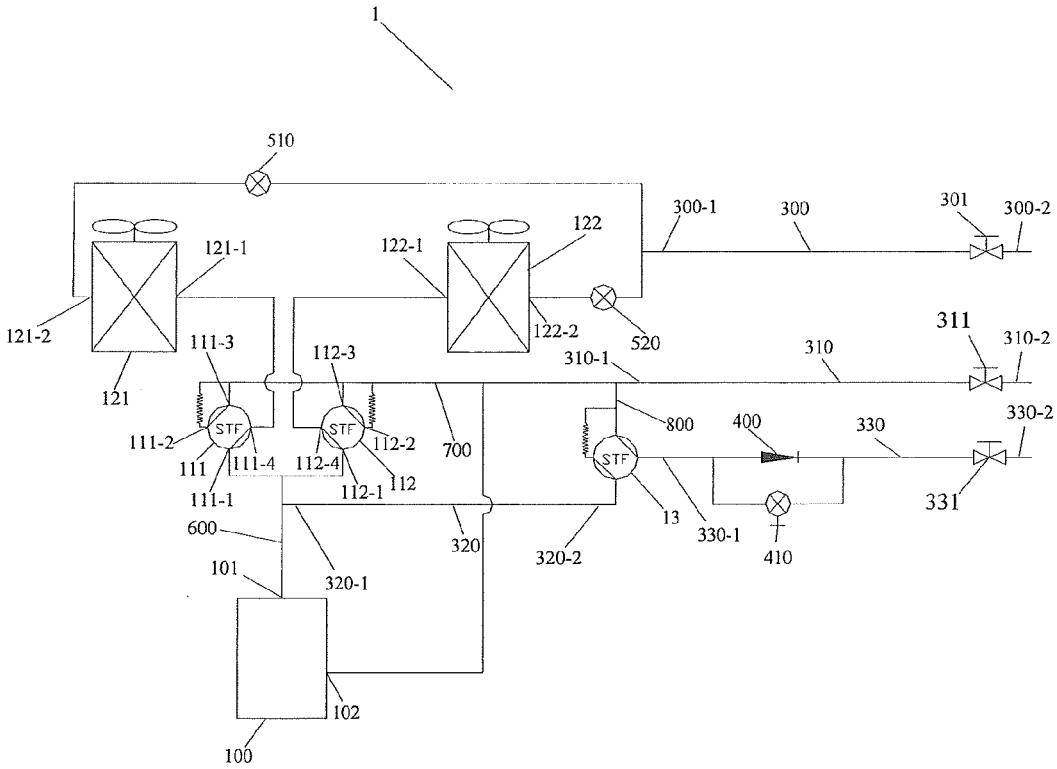
FIG. 2 is a schematic view of an outdoor unit of an air-conditioner according to another embodiment of the present disclosure.

As shown in FIG. 2, the outdoor heat exchanger 12 includes a first outdoor heat exchanger 121 and a second outdoor heat exchanger 122. Correspondingly, the number of the first four-way valve 11 is also two, i.e., the first four-way valve 111 and the first four-way valve 112.

The first port 111-1 of the first four-way valve 111 and the first port 112-1 of the first four-way valve 112 are connected with the outlet 101 of the compressor 100 and the first end 320-1 of the third gas pipe 320 via the first communicating pipe 600, i.e., the first port 111-1 of the first four-way valve 111 and the first port 112-1 of the first four-way valve 112 are connected with each other in parallel and then connected with the outlet 101 of the compressor 100 by the first communicating pipe 600, on the other hand, the first end 320-1 of the third gas pipe 320 is connected with the first communicating pipe 600.

The first end 310-1 of the first gas pipe 310 is connected with a second port 111-2 and a third port 111-3 of the first four-way valve 111, and a second port 112-2 and a third port 112-3 of the first four-way valve 112.

A fourth port 111-4 of the first four-way valve 111 is connected with a first refrigerant port 121-1 of the first outdoor heat exchanger 121 and a fourth port 112-4 of the first four-way valve 112 is connected with a first refrigerant port 122-1 of the second outdoor heat exchanger 122. A second refrigerant port 121-2 of the first outdoor heat exchanger 121 and a second refrigerant port 122-2 of the second outdoor heat exchanger 122 are connected with the first end 300-1 of the liquid pipe 300 respectively.

In addition, an expansion valve 510 may be disposed between the second refrigerant port 121-2 of the first outdoor heat exchanger 121 and the first end 300-1 of the liquid pipe 300, and an expansion valve 520 may be disposed between the second refrigerant port 122-2 of the second outdoor heat exchanger 122 and the first end 300-1 of the liquid pipe 300.

As other structures of the outdoor unit of the air-conditioner shown in FIG. 2 are the same with that of the outdoor unit of the air-conditioner shown FIG. 1, thus, the other structures of the outdoor unit in the present embodiment will be omitted.

When the outdoor unit 1 of the air-conditioner according to embodiments of the present disclosure is used in the two-pipe air-conditioning system, the second end 300-2 of the liquid pipe 300 and the second end 330-2 of the second gas pipe 330 are connected with two ends of an indoor unit assembly 2 respectively, so as to form a refrigerating cycle or a heating cycle of the two-pipe air-conditioning system. In this condition, the first gas pipe 310 is shut off by the third switch 311.

When the outdoor unit 1 of the air-conditioner according to embodiments of the present disclosure is used in the three-pipe air-conditioning system, the first gas pipe 310 and the second gas pipe 330 are connected with one end of the indoor unit assembly 2 via a refrigerant switching device 3 respectively, and the liquid pipe 300 is connected with the other end of the indoor unit assembly 2, so as to form a refrigerating cycle, a heating cycle or a mixed cycle (refrigerating and heating of the indoor unit assembly 2 at the same time) of the three-pipe air-conditioning system. In this condition, the first switch 301, the second switch 331 and the third switch 311 are ON.

The outdoor unit 1 according to embodiments of the present disclosure can be used in the two-pipe air-conditioning system or the three-pipe air-conditioning system, and there is no need to manufacture different outdoor units for different air-conditioning systems, thus improving the applicability of the outdoor unit and reducing the manufacturing cost of the air conditioner.

Structures of the two-pipe air-conditioning system and the three-pipe air-conditioning system, and refrigerant cycling paths thereof will be described in the following different embodiments of the present disclosure with reference to FIGS. 3-14.

Implementation 1

Figure 3:
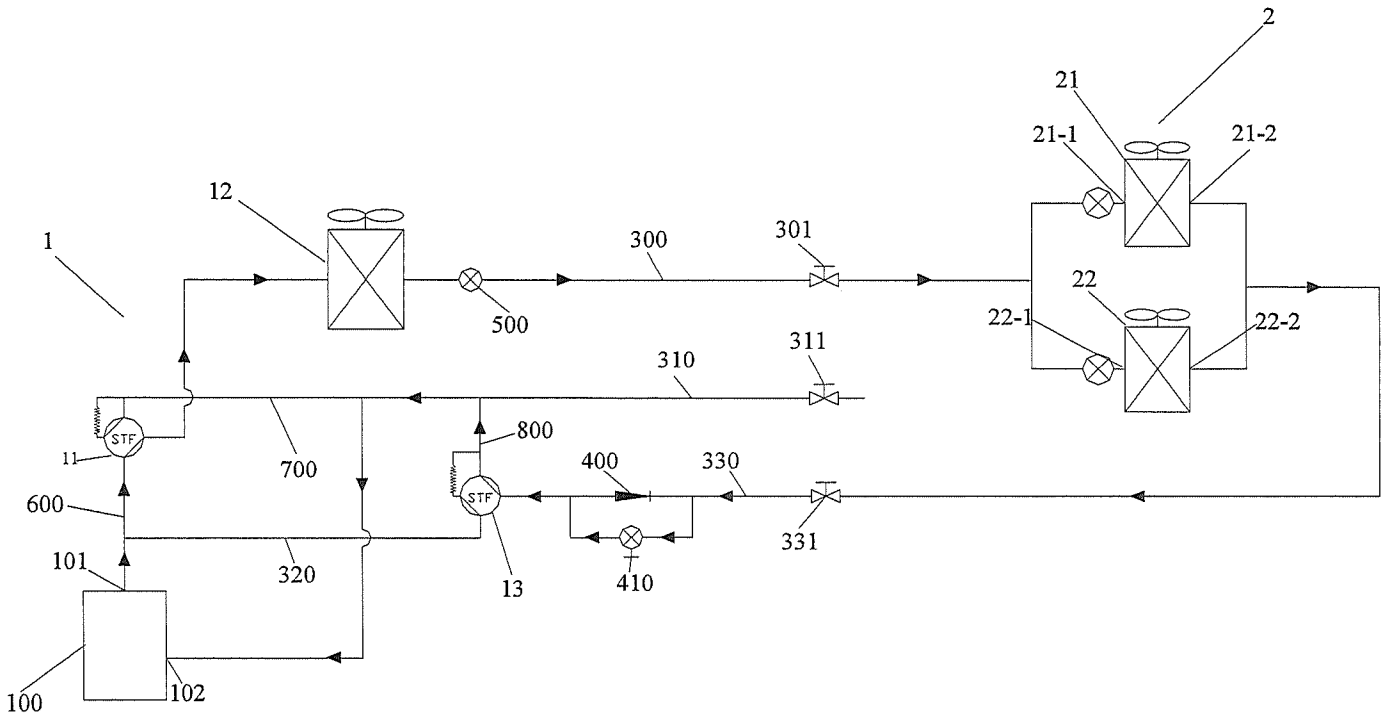
FIG. 3 is a schematic view showing a refrigerant cycling path of a two-pipe air-conditioning system according to an embodiment of the present disclosure in a refrigerating mode, in which the system uses the outdoor unit shown in FIG. 1.
Figure 4:
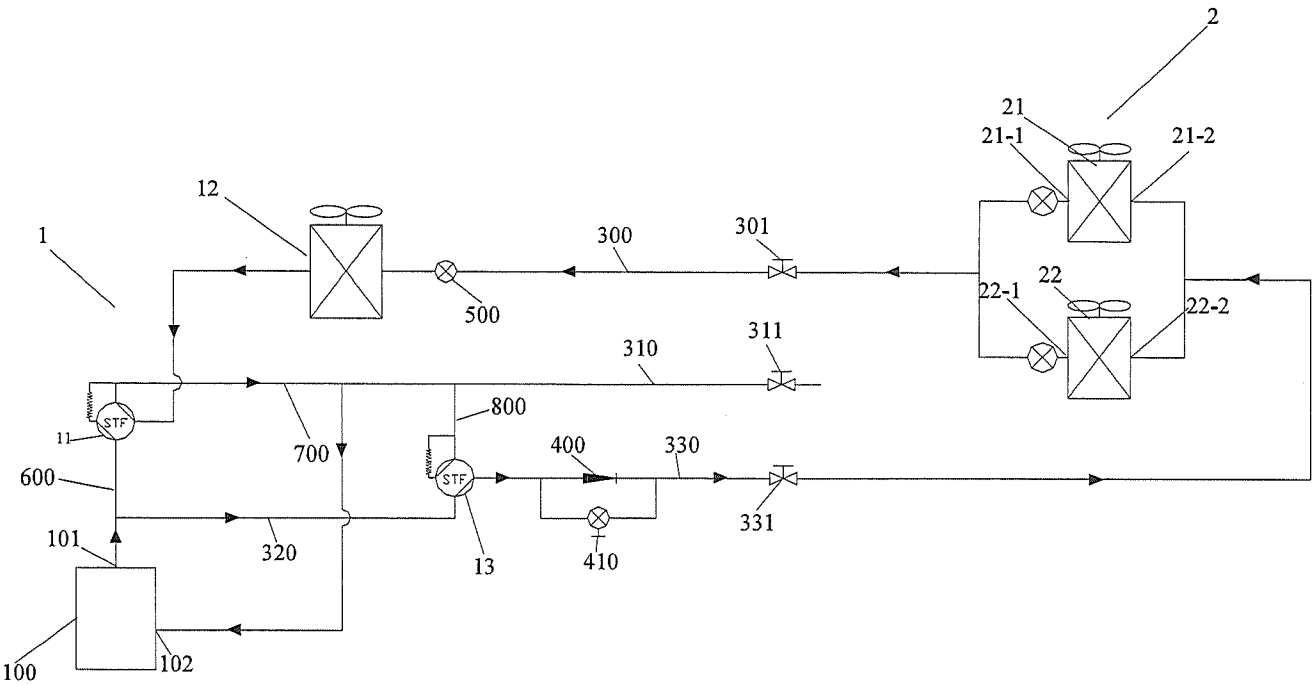
FIG. 4 is a schematic view showing a refrigerant cycling path of a two-pipe air-conditioning system according to an embodiment of the present disclosure in a heating mode, in which the system uses the outdoor unit shown in FIG. 1.

As shown in FIGS. 3 and 4, the two-pipe air-conditioning system, including the outdoor unit with one outdoor heat exchanger 12 and one first four-way valve 11, is described as an example in the implementation 1.

The two-pipe air-conditioning system according to the embodiment of the present disclosure includes the outdoor unit 1 and the indoor unit assembly 2.

The indoor unit assembly 2 may include at least one indoor unit. In the present embodiment, the indoor unit assembly 2 includes two indoor units 21 and 22.

The indoor unit 21 has a first refrigerant port 21-1 and a second refrigerant port 21-2, and the indoor unit 22 has a first refrigerant port 22-1 and a second refrigerant port 22-2. The first refrigerant 21-1 of the indoor unit 21 and the first refrigerant port 22-1 of the indoor unit 22 are connected with each other in parallel and then connected with the second end 300-2 of the liquid pipe 300, and the second refrigerant port 21-2 of the indoor unit 21 and the second refrigerant port 22-2 of the indoor unit 22 are connected with each other in parallel and then connected with the second end 330-2 of the second gas pipe 330.

FIG. 3 is a schematic view showing a refrigerant cycling path (as indicated by the arrows in FIG. 3) of a two-pipe air-conditioning system according to an embodiment of the present disclosure in a refrigerating mode, and the two-pipe air-conditioning system includes the outdoor unit shown in FIG. 1.

In the refrigerating mode, the first four-way valve 11 and the third switch 311 are OFF, and the second four-way valve 13, the first switch 301, the second switch 331 and the second control valve 410 are ON. The first four-way valve 11 communicates the outlet 101 with the outdoor heat exchanger 12, and the second four-way valve 13 communicates the second gas pipe 330 with the first gas pipe 310. Meanwhile, the outdoor heat exchanger 12 is configured as a condenser and the indoor unit assembly 2 is configured as an indoor refrigerating unit.

Gaseous refrigerant with a high temperature and a high pressure from the outlet 101 of the compressor 100, flowing through the first four-way valve 11, enters into the outdoor heat exchanger 12 to be condensed into liquid refrigerant with a high temperature. Through the expansion valve 500, the liquid pipe 300 and the first switch 301, the liquid refrigerant with a high temperature enters into the indoor units 21 and 22 of the indoor unit assembly 2 to be evaporated (i.e., to cool the indoor room) into gaseous refrigerant with a low temperature. Next, the gaseous refrigerant with a low temperature discharged from the indoor unit assembly 2 flows through the second gas pipe 330, the second switch 331, the second control valve 410, the second four-way valve 13, the first gas pipe 310 and the inlet 102 of the compressor 100, and finally flows back to the compressor 100, thus forming the complete refrigerating cycle of the refrigerant in the two-pipe air-conditioning system.

FIG. 4 is a schematic view illustrating a refrigerant cycling path (as indicated by the arrows in FIG. 4) of a two-pipe air-conditioning system according to an embodiment of the present disclosure in a heating mode, and the two-pipe air-conditioning system includes the outdoor unit shown in FIG. 1.

In the heating mode, the second four-way valve 13 and the third switch 311 are OFF, and the first four-way valve 11, the first switch 301 and the second switch 331 are ON. The first four-way valve 11 communicates the inlet 102 with the outdoor heat exchanger 12, and the second four-way valve 13 communicates the second gas pipe 330 with the third gas pipe 320. Meanwhile, the outdoor heat exchanger 12 is configured as an evaporator and the indoor unit assembly 2 is configured as an indoor heating unit.

The gaseous refrigerant with a high temperature and a high temperature from the outlet 101 of the compressor 100, flowing through the third gas pipe 320, the second four-way valve 13, the second gas pipe 330, the first control valve 400 and the second switch 331, enters into the indoor unit assembly 2 to be condensed (i.e., to heat the indoor room) into liquid refrigerant with a high temperature. Next, the liquid refrigerant with a high temperature discharged from the indoor unit assembly 2 flows through the liquid pipe 300, the first switch 301 and the expansion valve 500, and then enters into the outdoor heat exchanger 12 to be evaporated into the gaseous refrigerant with a low temperature. Finally, through the first four-way valve 11 and the inlet 102 of the compressor 100, the gaseous refrigerant with a low temperature flows back to the compressor 100, thus forming a complete heating cycle of the refrigerant in the two-pipe air-conditioning system.

Implementation 2

As shown in FIGS. 5-8, the three-pipe air-conditioning system, including the outdoor unit with one outdoor heat exchanger 12 and one first four-way valve 11, is described as an example in the implementation 2.

The three-pipe air-conditioning according to the embodiment of the present disclosure includes a first indoor unit assembly 23, a second indoor unit assembly 24, a refrigerant switching device 3 and the outdoor unit 1.

The first indoor unit assembly 23 includes at least one first indoor unit 231 and the second indoor unit assembly 24 includes at least one second indoor unit 241.

As shown in FIGS. 5-8, the numbers of the first indoor unit 231 and the second indoor unit 241 are two. First refrigerant ports 2311 of the two first indoor units 231 are connected with each other in parallel to form a first refrigerant port 23-1 of the first indoor unit assembly 23, and second refrigerant ports 2312 of the two first indoor units 231 are connected with each other in parallel to form a second refrigerant port 23-2 of the first indoor unit assembly 23. First refrigerant ports 2411 of the two second indoor units 241 are connected with each other in parallel to form a first refrigerant port 24-1 of the second indoor unit assembly 24, and second refrigerant ports 2412 of the two second indoor units 241 are connected with each other in parallel to form a second refrigerant port 24-2 of the second indoor unit assembly 24.

The refrigerant switching device 3 includes a first direction switching member 31 and a second direction switching member 32. The first direction switching member 31 includes a first port 31-1, a second port 31-2 and a third port 31-3, and the second direction switching member 32 includes a first port 32-1, a second port 32-2 and a third port 32-3. The first port 31-1 of the first direction switching member 31 is connected with the second refrigerant port 23-2 of the first indoor unit assembly 23, i.e., the first port 31-1 of the first direction switching member 31 is connected with the second refrigerant ports 2312 of the two first indoor units 231 respectively. The first port 32-1 of the second direction switching member 32 is connected with the second refrigerant port 24-2 of the second indoor unit assembly 24, i.e., the first port 32-1 of the second direction switching member 32 is connected with the second refrigerant ports 2412 of the two second indoor units 241 respectively.

The second port 31-2 of the first direction switching member 31 and the second port 32-2 of the second direction switching member 32 are connected with each other in parallel and then connected with the second end 310-2 of the first gas pipe 310. The third port 31-3 of the first direction switching member 31 and the third port 32-3 of the second direction switching member 32 are connected with each other in parallel and then connected with the second end 330-2 of the second gas pipe 330.

Each of the first direction switching member 31 and the second direction switching member 32 includes: first to fourth valves A-D. For example, in the first direction switching member 31, the first valves A is connected between the first port 31-1 and the second port 31-2 of the first direction switching member 31, the third valve C is connected between the first port 31-1 and the third port 31-3 of the first direction switching member 31, the second valve B is connected with the first valve A in parallel, and the fourth valve D is connected with the third valve C in parallel. The connection relationship of first to fourth valves of the second direction switching member 32 are the same with that of the first to fourth valves of the first direction switching member 31. Each of the first to fourth valves in the first direction switching member 31 and the second direction switching member 32 is any one of an electronic expansion valve, a four-way valve and an electromagnetic valve.

Those having the ordinary skills in the related art will be appreciated that, the first direction switching member 31 and the second direction switching member 32 may only have the first valve A and the third valve C, and with disposing the first to fourth valves A to D, the operation reliabilities of the first direction switching member 31 and the second direction switching member 32 can be ensured.

The structure of the outdoor unit 1 in the Implementation 2 is the same with that of the outdoor unit in Implementation 1, thus, is omitted here.

Figure 5:
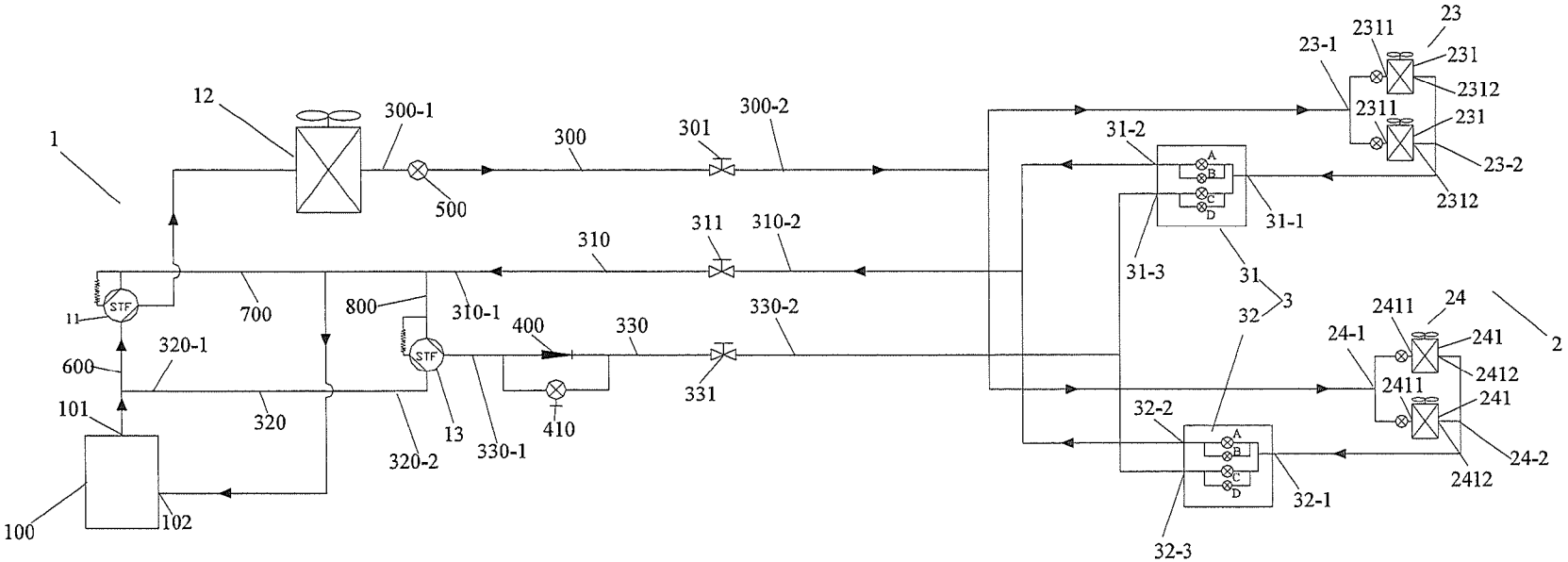
FIG. 5 is a schematic view showing a refrigerant cycling path of a three-pipe air-conditioning system according to an embodiment of the present disclosure in a refrigerating mode, in which the system uses the outdoor unit shown in FIG. 1.

FIG. 5 is a schematic view illustrating a refrigerant cycling path (as indicated by the arrows in FIG. 5) of a three-pipe air-conditioning system according to an embodiment of the present disclosure in the refrigerating mode.

In the refrigerating mode, the first four-way valve 11 and the second control valve 410 are OFF, and the second four-way valve 13, the first switch 301, the second switch 331, the third switch 311 and first to fourth valves A-D of the first direction switching member 31 and the second direction switching member 32 are ON. Meanwhile, the outdoor heat exchanger 12 is configured as the condenser and the first indoor unit assembly 23 and the second indoor unit assembly 24 are configured as the indoor refrigerating units.

Gaseous refrigerant with a high temperature and a high pressure, from the outlet 101 of the compressor 100, flowing through the first four-way valve 11 enters into the outdoor heat exchanger 12 to be condensed into liquid refrigerant with a high temperature. The liquid refrigerant with a high temperature flows through the expansion valve 500, the liquid pipe 300 and the first switch 301, and enters into the first indoor unit assembly 23 and the second indoor assembly 24 to be evaporated into the gaseous refrigerant with a low temperature. Then, the gaseous refrigerant with a low temperature flows through the first valve A and the second valve B of the first direction switching member 31 and the second direction switching member 32 respectively, and finally flows back to the compressor 100 through the first gas pipe 310, the third switch 311 and the inlet 102 of the compressor 100, thus forming the complete refrigerating cycle of the refrigerant in the three-pipe air-conditioning system.

Figure 6:
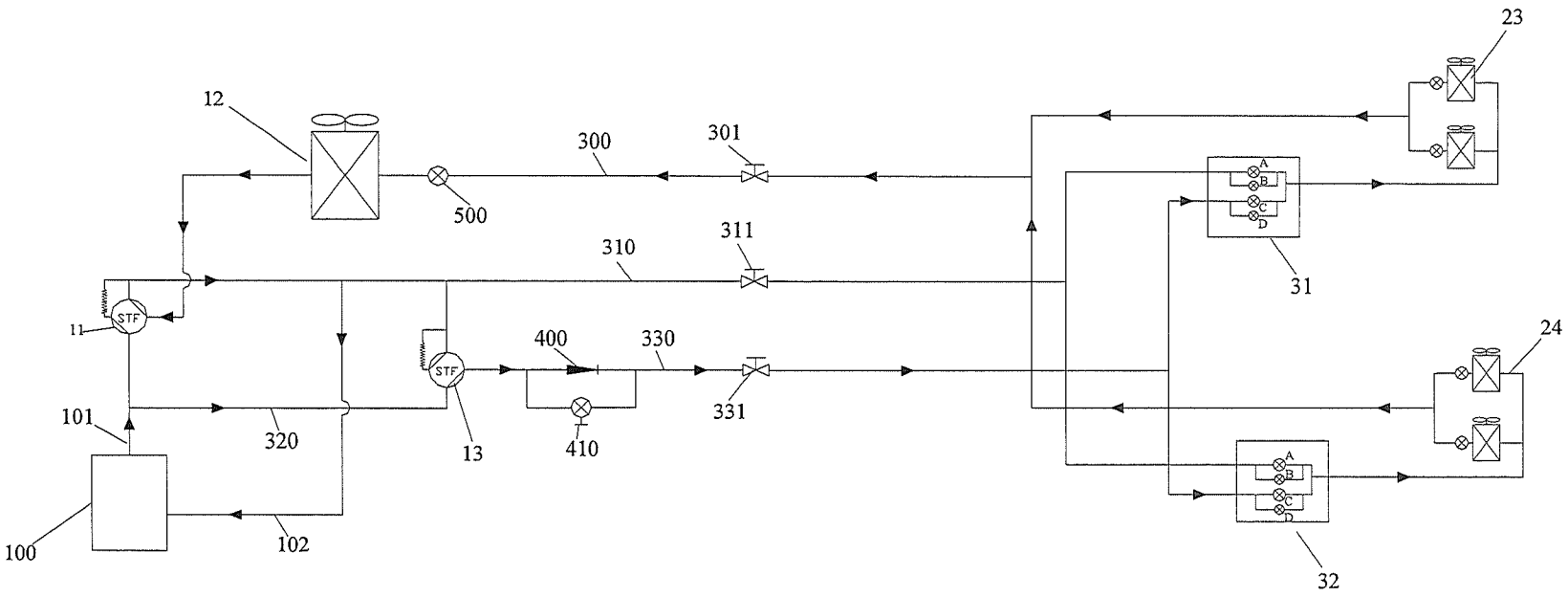
FIG. 6 is a schematic view showing a refrigerant cycling path of a three-pipe air-conditioning system according to an embodiment of the present disclosure in a heating mode, in which the system uses the outdoor unit shown in FIG. 1.

FIG. 6 is a schematic view illustrating a refrigerant cycling path (as indicated by the arrows in FIG. 6) of a three-pipe air-conditioning system according to an embodiment of the present disclosure in the heating mode.

In the heating mode, the second four-way valve 13, the second control valve 410, the first ports A and the second ports B of the first direction switching member 31 and the second direction switching member 32 are OFF, and the first four-way valve 11, the first switch 301, the second switch 331, the third switch 311, the third ports C and the fourth ports D of the first direction switching member 31 and the second direction switching member 32 are ON. Meanwhile, the outdoor heat exchanger 12 is configured as an evaporator and the indoor unit assembly 2 is configured as an indoor heating unit.

The gaseous refrigerant with a high temperature and a high pressure, from the outlet 101 of the compressor 100, flowing through the third gas pipe 320, the second four-way valve 13, the second gas pipe 330, the first control valve 400, the second switch 331, the third ports C and the fourth ports D of the first direction switching member 31 and the second direction switching member 32, enters into the first indoor unit assembly 23 and the second indoor unit assembly 24 respectively to be condensed into the liquid refrigerant with a high temperature. The liquid refrigerant with a high temperature discharged from the first indoor unit assembly 23 and the second indoor unit assembly 24 flows through the liquid pipe 300, the first switch 301 and the expansion valve 500, then enters into the outdoor heat exchanger 12 to be evaporated into the gaseous refrigerant with a low temperature. The gaseous refrigerant with a low temperature flows through the first four-way valve 11 and the inlet 102 of the compressor 100 and flows back to the compressor 100, thus forming the complete heating cycle of the refrigerant in the three-pipe air-conditioning system.

Figure 7:
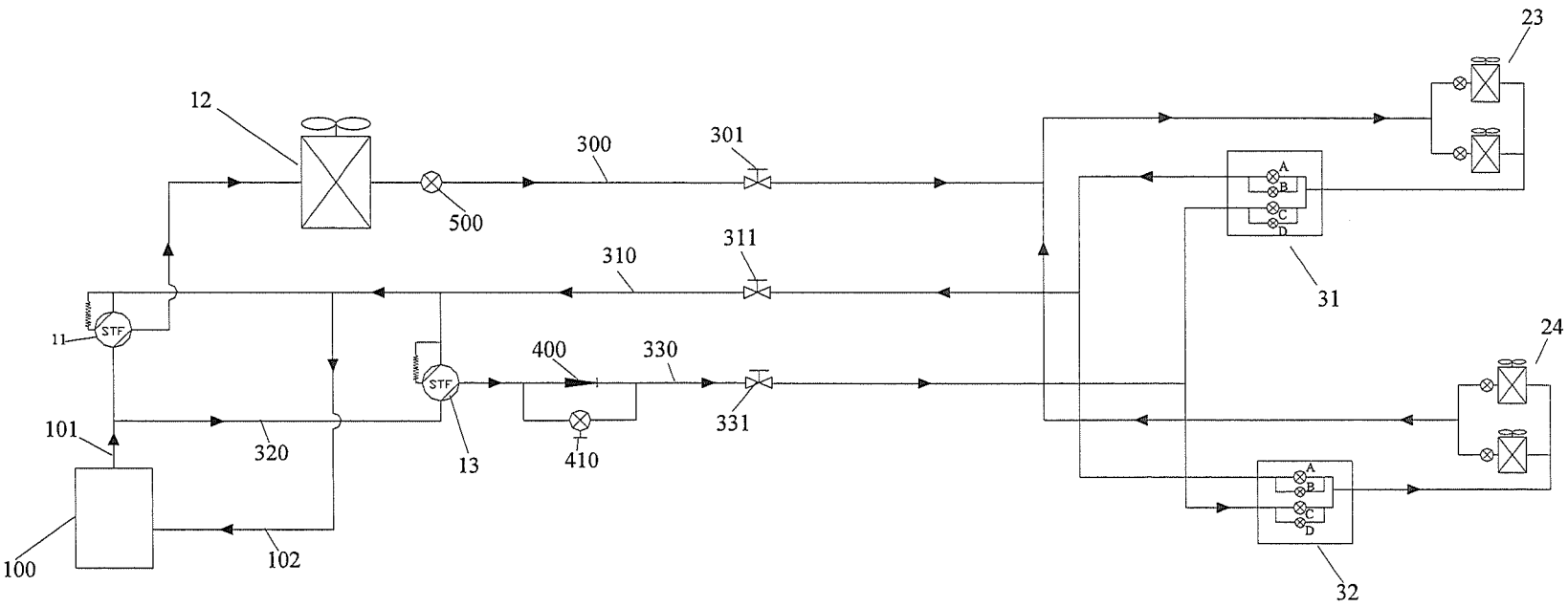
FIG. 7 is a schematic view showing a refrigerant cycling path of a three-pipe air-conditioning system according to an embodiment of the present disclosure in one mixed mode, in which the system uses the outdoor unit shown in FIG. 1.

FIG. 7 is a schematic view illustrating a refrigerant cycling path (as indicated by the arrows in FIG. 7) of a three-pipe air-conditioning system according to an embodiment of the present disclosure in a mixed mode.

In the mixed mode, the first four-way valve 11, the second four-way valve 13, the second control valve 410, the third valve C and the fourth valve D of the first direction switching member 31 and the first valve A and the second valve B of the second direction switching member 32 are OFF, and the first switch 301, the second switch 331, the third switch 311, the first valve A and the second valve B of the first direction switching member 31 and the third valve C and the fourth valve D of the second direction switching member 32 are ON. Meanwhile, the outdoor heat exchanger 12 is configured as a condenser, and the first indoor unit assembly 23 is configured as an indoor refrigerating unit, and the second indoor unit assembly 24 is configured as an indoor heating unit.

After being discharged from the outlet 101 of the compressor, the gaseous refrigerant with a high temperature and a high pressure is divided into two flowing paths. The refrigerant of the first flowing path flows into the outdoor heat exchanger 12 through the first four-way valve 11, so as to be condensed into the liquid refrigerant with a high temperature. The liquid refrigerant with a high temperature flows through the expansion valve 500, the liquid pipe 300 and the first switch 301. On the other hand, the refrigerant of the second flowing path enters into the second indoor unit assembly 24 through the third gas pipe 320, the second four-way valve 13, the second gas pipe 330, the first control valve 400, the second switch 331 and the third valve C and the fourth D of the second direction switching member 32, so as to be condensed into the liquid refrigerant with a high temperature. The liquid refrigerant of the second flowing path with a high temperature, discharged from the second indoor unit assembly 24, joins gather with the liquid refrigerant of the first flowing path with a high temperature and then flows into the first indoor unit assembly 23 to be evaporated into the gaseous refrigerant with a low temperature. Finally, the gaseous refrigerant with a low temperature, discharged from the first indoor unit assembly 23, flows back to the compressor 100 through the first valve A and the second valve B of the first direction switching member 31, the first gas pipe 310, the third switch 311 and the inlet 102 of the compressor 100, thus forming the complete mixed cycle of the refrigerant in the three-pipe air-conditioning system.

Figure 8:
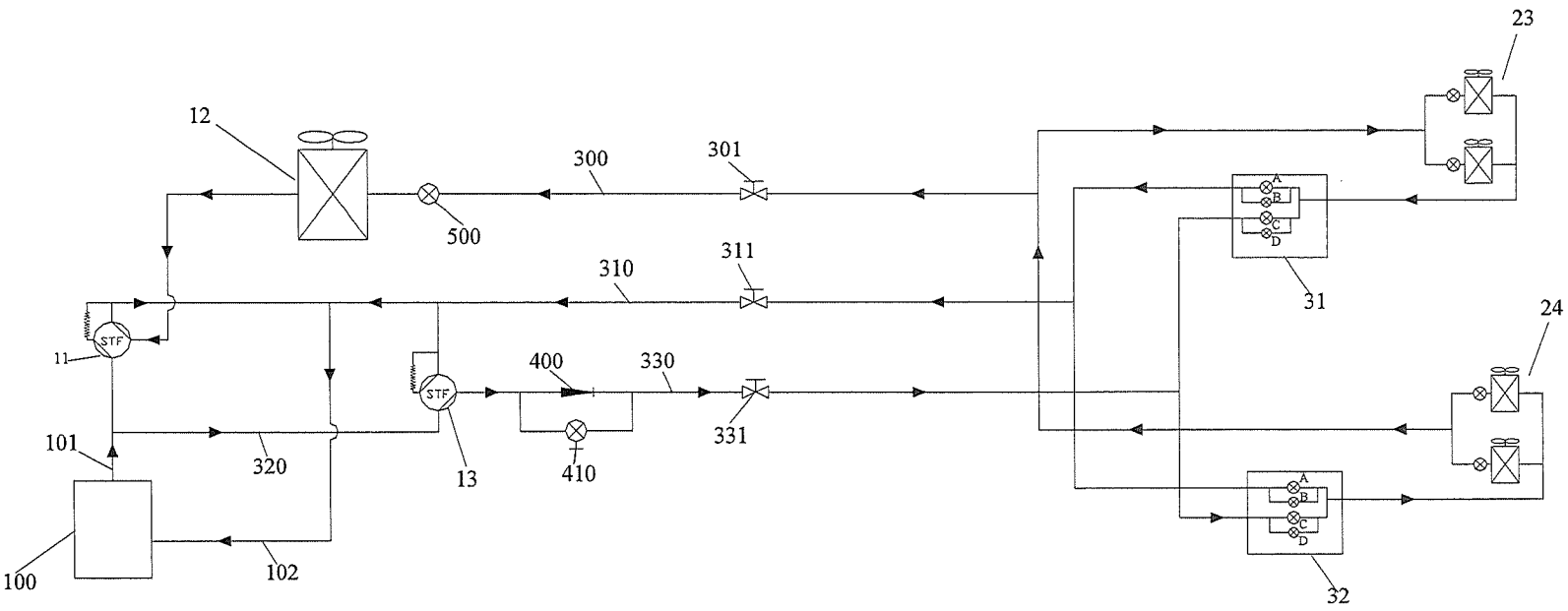
FIG. 8 is a schematic view showing a refrigerant cycling path of a three-pipe air-conditioning system according to an embodiment of the present disclosure in another mixed mode, in which the system uses the outdoor unit in FIG. 1.

FIG. 8 is a schematic view illustrating a refrigerant cycling path (as indicated by the arrows in FIG. 8) of a three-pipe air-conditioning system according to an embodiment of the present disclosure in another mixed mode.

In the mixed mode, the second four-way valve 13, the third valve C and the fourth valve D of the first direction switching member 31 and the first valve A and the second B of the second direction switching member 32 are OFF, and first four-way valve 11, the first switch 301, the second switch 331, the third switch 311, the first valve A and the second valve B of the first direction switching member 31 and the third valve C and the fourth valve D of the second direction switching member 32 are ON. Meanwhile, the outdoor heat exchanger 12 is configured as an evaporator, the first indoor unit assembly 23 is configured as an indoor refrigerating unit and the second indoor unit assembly 24 is configured as an indoor heating unit.

After being discharged from the outlet 101 of the compressor 100, the gaseous refrigerant with a high temperature and a high pressure enters into the second indoor unit assembly 24 through the third gas pipe 320, the second four-way valve 13, the second gas pipe 330, the first control valve 400, the second switch 331 and the third valve C and the fourth valve D of the second direction switching member 32, so as to be condensed into the liquid refrigerant with a high temperature. The liquid refrigerant, discharged from the second indoor unit assembly 24, is divided into two flowing paths. The refrigerant of the first flowing path enters into the outdoor heat exchanger 12 through the liquid pipe 300 and the first switch 301, so as to be evaporated into the gaseous refrigerant with a low temperature, and the gaseous refrigerant with a low temperature flows to the inlet 102 through the first four-way valve 11. On the other hand, the refrigerant of the second flowing path enters into the first indoor unit assembly 23 to be evaporated into the gaseous refrigerant with a low temperature, and the gaseous refrigerant of the second flowing path with a low temperature, discharged from the first indoor unit assembly 23, flows to the inlet 102 through the first valve A and the second valve B of the first direction switching member 31, the first gas pipe 310. The gaseous refrigerants of the first and second flowing paths with a low temperature joins together at the inlet 102 and flows back to the compressor 100, thus forming another complete mixed cycle of the refrigerant in the three-pipe air-conditioning system.

According to embodiments of the present disclosure, the outdoor unit 1 having one outdoor heat exchanger 12 and one first four-way valve 11 is adapted to be used in the two-pipe air-conditioning system or the three-pipe air-conditioning system.

It can be understood by those having the ordinary skills in the related art, the number of the indoor unit assembly 2 is not limited, i.e., the indoor unit assembly 2 may further include a third and a fourth indoor unit assemblies, and all of the indoor units in a same indoor unit assembly only refrigerate or heat at the same time.

Implementation 3

Figure 9:
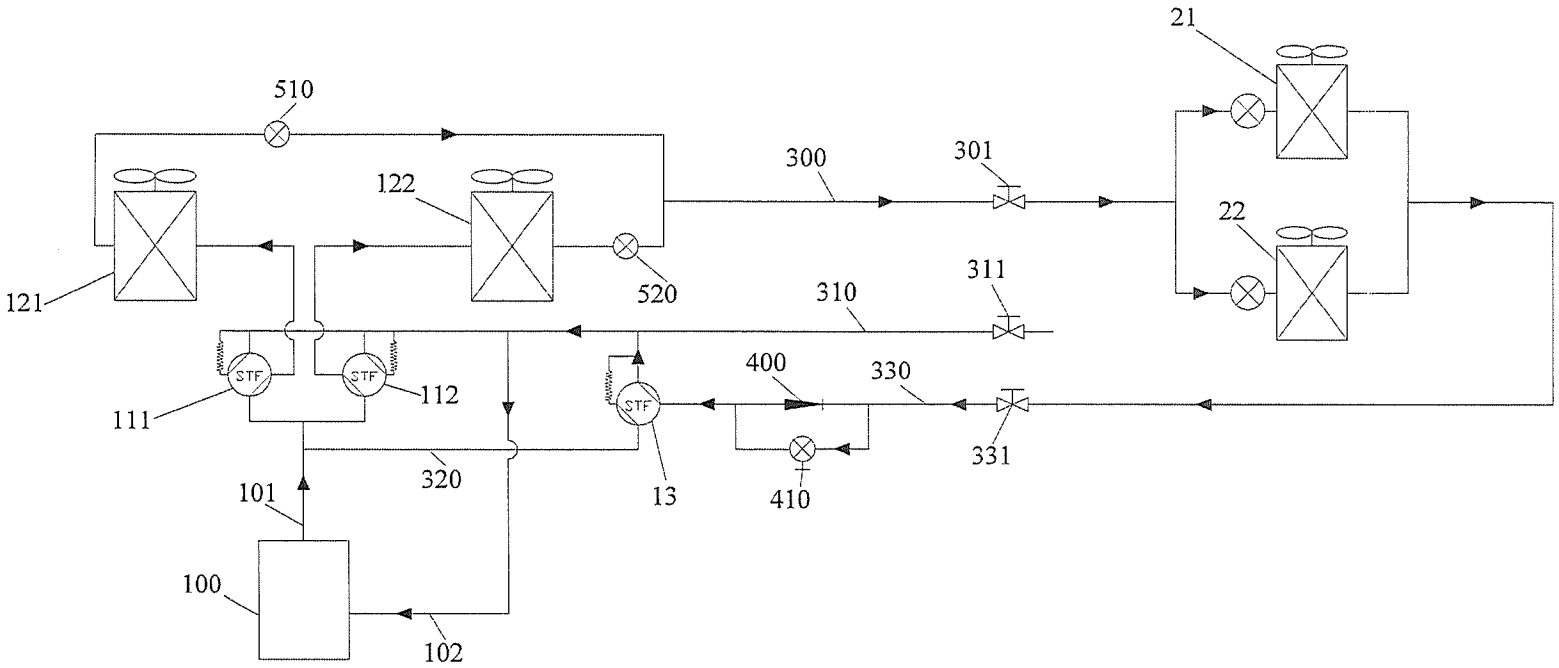
FIG. 9 is a schematic view showing a refrigerant cycling path of a two-pipe air-conditioning system according to an embodiment of the present disclosure in a refrigerating mode, in which the system uses the outdoor unit shown in FIG. 2.
Figure 10:
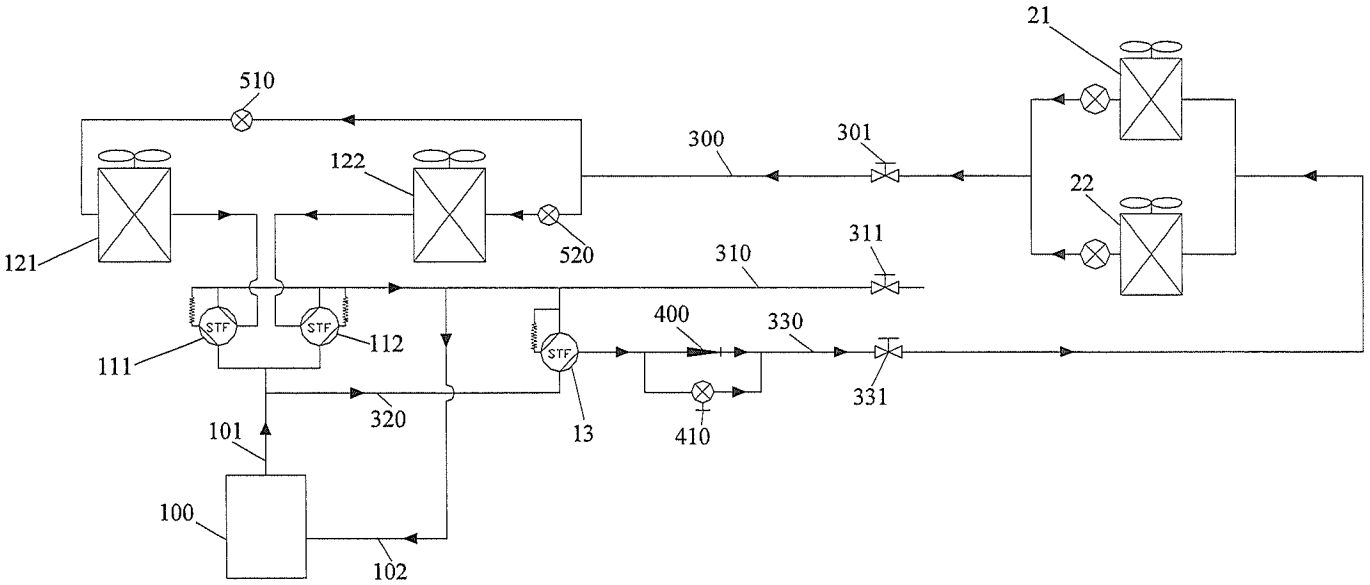
FIG. 10 is a schematic view showing a refrigerant cycling path of a two-pipe air-conditioning system according to an embodiment of the present disclosure in a heating mode, in which the system uses the outdoor unit shown in FIG. 2.

As shown in FIGS. 9 and 10, the two-pipe air-conditioning system, including the outdoor unit with two outdoor heat exchangers 121 and 122 and two first four-way valves 111 and 112, is described as an embodiment in Implementation 3.

The two-pipe air-conditioning system includes an expansion valve 510 connected between the liquid pipe 300 and the outdoor heat exchanger 121 and an expansion valve 520 connected between the liquid pipe 300 and the outdoor heat exchanger 122. Other structures of the two-pipe air-conditioning system in Implementation 3 are the same with those of the two-pipe air-conditioning system in Embodiment 1.

FIG. 9 is a schematic view illustrating a refrigerant cycling path (as indicated by the arrows in FIG. 9) of a two-pipe air-conditioning system according to an embodiment of the present disclosure in a refrigerating mode with the outdoor unit in FIG. 2.

In the refrigerating mode, the first four-way valve 111, the first four-way valve 112 and the third switch 311 are OFF, and the second four-way valve 13, the first switch 301, the second switch 331 and the second control valve 410 are ON, so that the first four-way valve 111 communicates the outlet 101 with the outdoor heat exchanger 121 and the first four-way valve 112 communicates the outlet 101 with the outdoor heat exchanger 122, and the second four-way valve 13 communicates the second gas pipe 330 with the first gas pipe 310. The outdoor heat exchanger 121 and the outdoor heat exchanger 122 are configured as the condensers, and the indoor unit assembly 2 is configured as the refrigerating unit.

After being discharged from the outlet 101 of the compressor, the gaseous refrigerant with a high temperature and a high pressure enters into the outdoor heat exchanger 121 and the outdoor heat exchanger 122 through the first four-way valve 111 and the first four-way valve 112 respectively, so as to be condensed into the liquid refrigerant with a high temperature. The liquid refrigerant with a high temperature discharged from the outdoor heat exchanger 121 and the outdoor heat exchanger 122 joins together after flowing through the expansion valve 510 and the expansion valve 520 respectively, and enters into the indoor unit assembly 2 through the liquid pipe 300 and the first switch 301, so as to be evaporated into the gaseous refrigerant with a low temperature. The gaseous refrigerant with a low temperature, discharged from the indoor unit assembly 2, flows back to the compressor 100 through the second gas pipe 330, the second switch 331, the second control valve 410, the second four-way valve 13, the first gas pipe 310 and the inlet 102 of the compressor 100, thus forming the complete refrigerating cycle of the refrigerant in the two-pipe air-conditioning system.

FIG. 10 is a schematic view illustrating a refrigerant cycling path (as indicated by the arrows in FIG. 10) of a two-pipe air-conditioning system according to an embodiment of the present disclosure in a heating mode.

In the heating mode, the second four-way valve 13 and the third switch 311 are OFF, and the first four-way valve 111, the first four-way valve 112, the first switch 301 and the second switch 331 are ON, so that the first four-way valve 111 communicates the inlet 102 with the outdoor heat exchanger 121 and the first four-way valve 112 communicates the inlet 102 with the outdoor heat exchanger 122, and the second four-way valve 13 communicates the second gas pipe 330 with the third gas pipe 320. Both of the outdoor heat exchanger 121 and the outdoor heat exchanger 122 are configured as the evaporators, and the indoor unit assembly 2 is configured as the heating unit.

After being discharged from the outlet 101 of the compressor 100, the gaseous refrigerant flows enters into the indoor unit assembly 2 through the third gas pipe 320, the second four-way valve 13, the second gas pipe 330, the first control valve 400 and the second switch 331, so as to be condensed into the liquid refrigerant with a high temperature. The liquid refrigerant with a high temperature, discharged from the indoor unit assembly 2, flows through the first switch 301 and the liquid pipe 300, then is divided into two flowing paths. The refrigerant of the first flowing path enters into the outdoor heat exchanger 121 through the expansion valve 510, so as to be evaporated into the gaseous refrigerant with a low temperature, and the gaseous refrigerant with a low temperature flows to the first four-way valve 111. On the other hand, the refrigerant of the second flowing path enters into the outdoor heat exchanger 122 through the expansion valve 520, so as to be evaporated into the gaseous refrigerant with a low temperature, and the gaseous refrigerant with a low temperature flows to the first four-way valve 112. Finally, the gaseous refrigerant discharged from the first four-way valves 111 and 112 joins together and flows back to the compressor 100 via the inlet 102 of the compressor, thus forming the complete heating cycle of the refrigerant in the two-pipe air-conditioning system.

Embodiment 4

Figure 11:
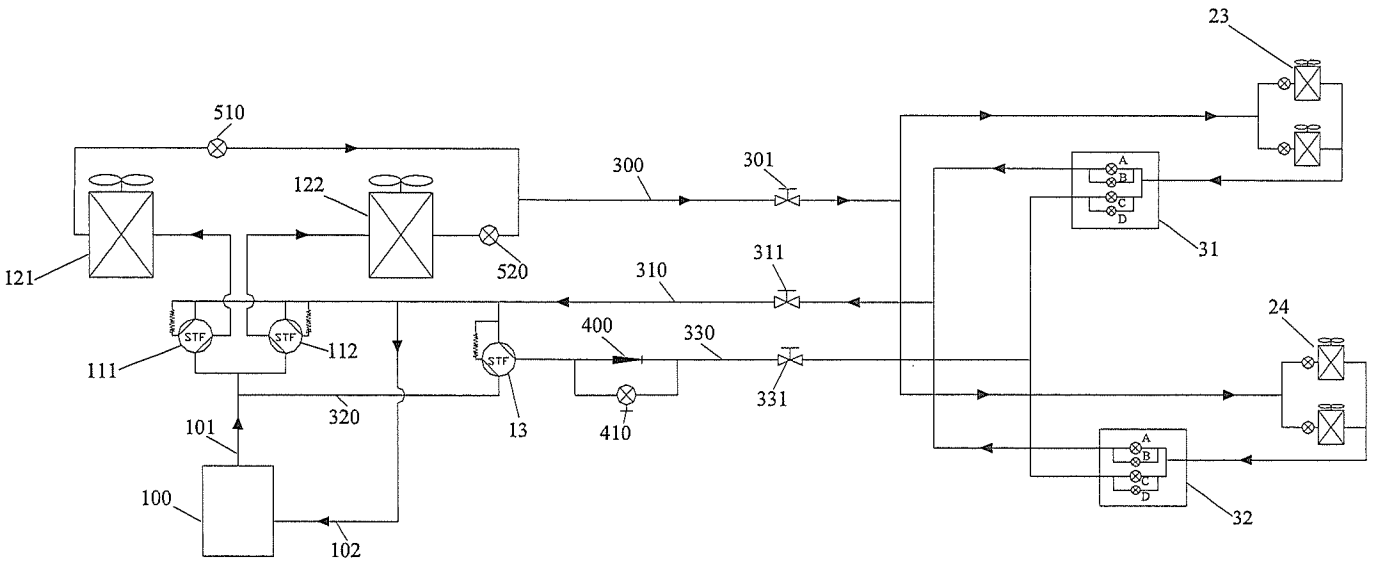
FIG. 11 is a schematic view showing a refrigerant cycling path of a three-pipe air-conditioning system according to an embodiment of the present disclosure in a refrigerating mode, in which the system uses the outdoor unit shown in FIG. 2.
Figure 12:
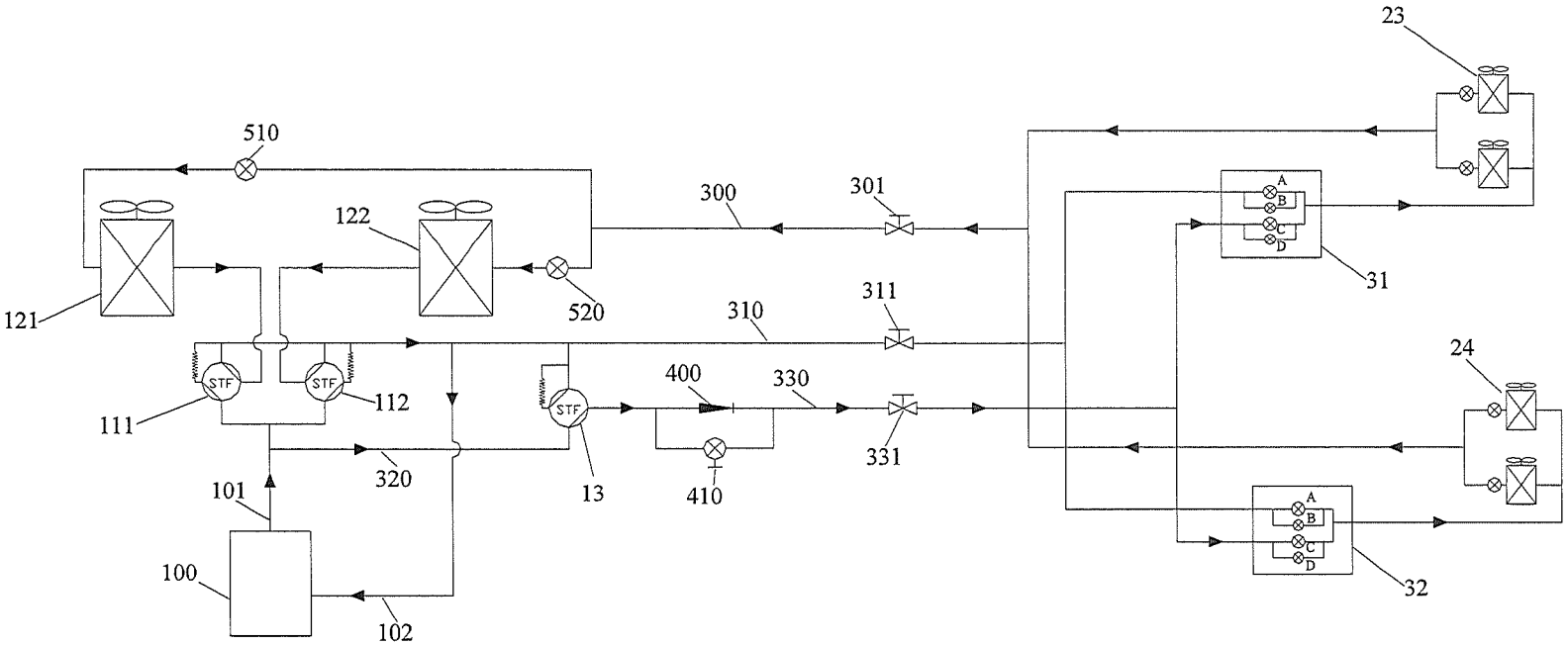
FIG. 12 is a schematic view showing a refrigerant cycling path of a three-pipe air-conditioning system according to an embodiment of the present disclosure in a heating mode, in which the system uses the outdoor unit shown in FIG. 2.
Figure 13:
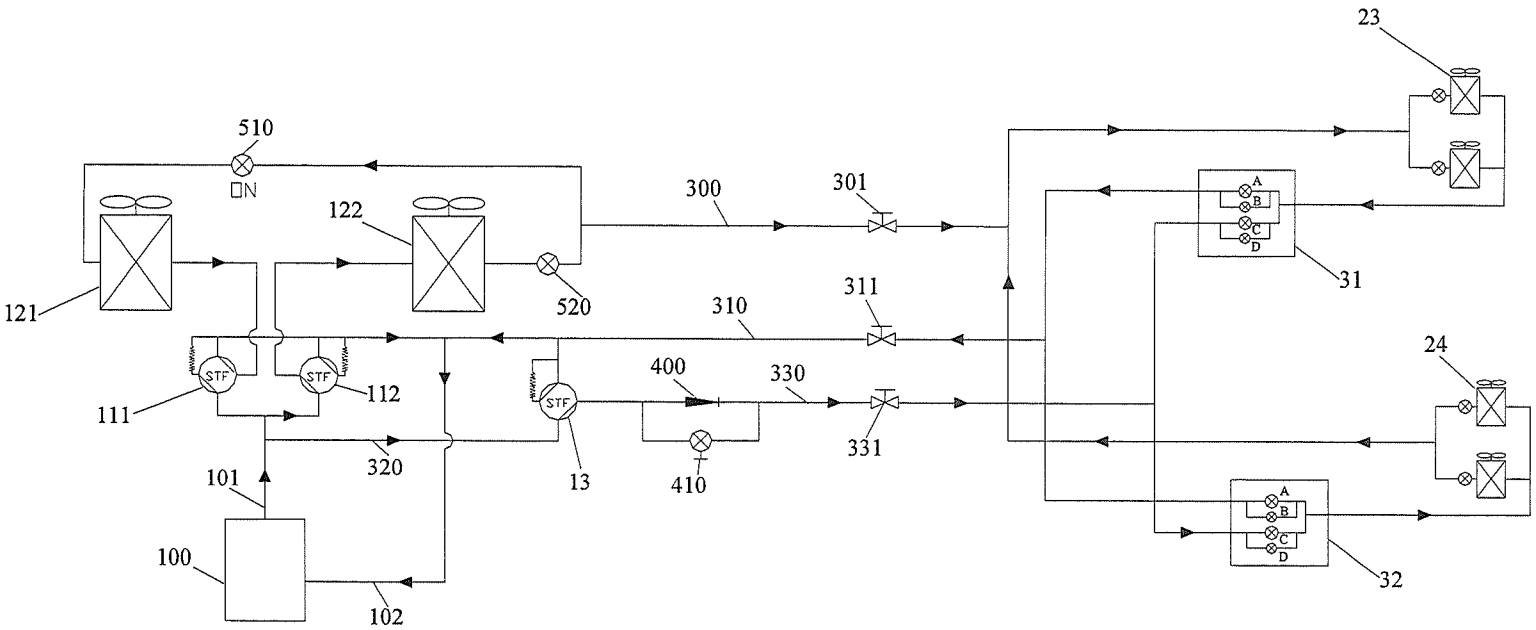
FIG. 13 is a schematic view showing a refrigerant cycling path of a three-pipe air-conditioning system according to an embodiment of the present disclosure in a mixed mode, in which the system uses the outdoor unit shown in FIG. 2.

As shown in FIGS. 11-13, the three-pipe air-conditioning system, including the outdoor unit with two outdoor heat exchangers 121 and 122 and two first four-way valves 111 and 112, is described as an example in Implementation 4.

The three-pipe air-conditioning according to the embodiment of the present disclosure further includes an expansion valve 510 connected between the liquid pipe 300 and the outdoor heat exchanger 121 and an expansion valve 520 connected between the liquid pipe 300 and the outdoor heat exchanger 122. Other structures of the three-pipe air-conditioning system in Implementation 4 are the same with those of the three-pipe air-conditioning system in Implementation 2.

FIG. 11 is a schematic view illustrating a refrigerant cycling path (as indicated by the arrows in FIG. 11) of a three-pipe air-conditioning system according to an embodiment of the present disclosure in a refrigerating mode.

In the refrigerating mode, the first four-way valve 111 and the first four-way valve 112 are OFF, the second four-way valve 13, the first switch 301, the second switch 331, the third switch 311, and the first to fourth valves A-D of the first direction switching member 31 and the second direction switching member 32 are ON. Meanwhile, both of the outdoor heat exchangers 121 and 122 are configured as the condensers, and both of the first indoor unit assembly 23 and the second indoor unit assembly 24 are configured as the indoor refrigerating units.

After being discharged from the outlet 101 of the compressor 100, the gaseous refrigerant with a high temperature and a high pressure enters into the outdoor heat exchanger 121 and the outdoor heat exchanger 122 through the first four-way valve 111 and the first four-way valve 112 respectively, so as to be condensed into the liquid refrigerant with a high temperature. The liquid refrigerant with a high temperature, discharged from the outdoor heat exchanger 121 and the outdoor heat exchanger 122, join together after flowing through the expansion valve 510 and the expansion valve 520 respectively, and then enters into the first indoor unit assembly 23 and the second indoor unit assembly 24 through the liquid pipe 300 and the first switch 301 respectively, so as to be evaporated into the gaseous refrigerant with a low temperature. The gaseous refrigerant with a low temperature, discharged from the first indoor unit assembly 23 and the second indoor unit assembly 24, joins together after flowing through the first valves A and the second valves B of the first direction switching member 31 and the second direction switching member 32 respectively Finally, the gaseous refrigerant with a low temperature flows back to the compressor 100 through the first gas pipe 310, the third switch 311 and the inlet 102 of the compressor 100, thus forming the complete refrigerating cycle of the refrigerant in the three-pipe air-conditioning system.

FIG. 12 is a schematic view illustrating a refrigerant cycling path (as indicated by the arrows in FIG. 12) of a three-pipe air-conditioning system according to an embodiment of the present disclosure in a heating mode.

In the heating mode, the second four-way valve 13, the second control valve 410 and the first valves A and the second valves B of the first direction switching member 31 and the second direction member 32 are OFF, and the first four-way valve 111, the first four-way valve 112, the first switch 301, the second switch 331, the third switch 311 and the third valves C and the fourth valves D of the first direction switching member 31 and the second direction switching member 32 are ON. Meanwhile, both of the outdoor heat exchanger 121 and the outdoor heat exchanger 122 are configured as the evaporators, and both of the first indoor unit assembly 23 and the second indoor unit assembly 24 are configured as the indoor heating units.

After being discharged from the outlet 101 of the compressor 100, the gaseous refrigerant with a high temperature and a high pressure enters into the first indoor unit assembly 23 and the second indoor unit assembly 24 respectively through the third gas pipe 320, the second four-way valve 13, the second gas pipe 330, the first control valve 400, the second switch 331 and the third valves C and the fourths D of the first direction switching member 31 and the second direction switching member 32, so as to be condensed into the liquid refrigerant with a high temperature. The liquid refrigerant discharged from the first indoor unit assembly 23 and the liquid refrigerant discharged from the second indoor unit assembly 24, joins together and flows through the first switch 301 and the liquid pipe 300, then enters into the outdoor heat exchanger 121 and the outdoor heat exchanger 122 respectively through the expansion valve 510 and the expansion valve 520, so as to be evaporated into the gaseous refrigerant with a low temperature. The gaseous refrigerant discharged from the outdoor heat exchanger 121 and the gaseous refrigerant discharged from the outdoor heat exchanger 122 joins together after flowing through the first four-way valve 111 and the first four-way valve 112 respectively, and finally flows back to the compressor 100 via the third gas pipe 320 and the inlet 102 of the compressor 100, thus forming the complete heating cycle of the refrigerant in the three-pipe air-conditioning system.

FIG. 13 is a schematic view illustrating a refrigerant cycling path (as indicated by the arrows in FIG. 13) of a three-pipe air-conditioning system according to an embodiment of the present disclosure in a mixed mode.

In the mixed mode, the first four-way valve 112, the second four-way valve 13, the third valve C and the fourth valve D of the first direction switching member 31 and the first valve A and the second valve B of the second direction switching member 32 are OFF, and the first four-way valve 111, the first switch 301, the second switch 331, the third switch 311, the first valve A and the second valve B of the first direction switching member 31 and the third valve C and the fourth valve D of the second direction switching member 32 are ON. Meanwhile, the outdoor heat exchanger 121 is configured as the evaporator, the outdoor heat exchanger 122 is configured as the condenser, the first indoor unit assembly 23 is configured as the indoor refrigerating unit and the second indoor unit assembly 24 is configured as the indoor heating unit.

After being discharged from the outlet 101 of the compressor 100, the gaseous refrigerant with a high temperature and a high pressure is divided into two flowing paths. The refrigerant of the first flowing path enters into the second unit assembly 24 through the third gas pipe 320, the second four-way valve 13, the second gas pipe 330, the first control valve 400, the second switch 331 and the third valve C and the fourth valve D of the second direction switching member 32, so as to be condensed into the liquid refrigerant with a high temperature. On the other hand, the refrigerant of the second flowing path enters into the outdoor heat exchanger 122 through the first four-way valve 112, so as to be condensed into the liquid refrigerant with a high temperature. Subsequently, the liquid refrigerant of the second flowing path is further divided into a third flowing path and a fourth flowing path after flowing through the expansion valve 520. The refrigerant of the third flowing path enters into the outdoor heat exchanger 121 through the expansion valve 510, so as to be evaporated into the gaseous refrigerant with a low temperature, and the gaseous refrigerant with a low temperature flows to the inlet 102 via the first four-way valve 111. The refrigerant of the fourth flowing path flows through the liquid pipe 300 and the first switch 301, and joins together with the refrigerant of the first flowing path. The refrigerant of the first and fourth flowing paths enters into the first indoor unit assembly 23 to be evaporated into the gaseous refrigerant with a low temperature. The gaseous refrigerant discharged from the first indoor unit assembly 23 flows through the first valve A and the second valve B of the first direction switching member 31, the third switch 311 and the first gas pipe 310 and then joins together with the refrigerant of the third flowing path at the inlet 102. Finally, all of the refrigerant flows back to the compressor 100 via the inlet 102, thus forming the complete mixed cycle of the refrigerant in the three-pipe air-conditioning system.

It can be understood by those having the ordinary skills in the related art, the number of the indoor unit assembly 2 is not limited, i.e., the three-pipe air-conditioning system may further include a third and a fourth indoor unit assemblies, and all of indoor units in a same indoor unit assembly only refrigerate or heat at the same time. The number of the outdoor heat exchanger may be more than two. In addition, the first indoor unit assembly may be configured as the indoor heating unit and the second indoor unit assembly 24 may be configured as the indoor refrigerating unit.

The outdoor unit according to embodiments of the present disclosure, having two outdoor heat exchangers 121 and 122 and two first four-way valves 111 and 112, is adapted to be used in both the two-pipe air-conditioning system or the three-pipe air-conditioning system.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An outdoor unit of an air-conditioner, comprising:

a compressor defining an outlet and an inlet;

a first four-way valve defining first to fourth ports, the first port of the first four-way valve being communicated with the outlet of the compressor, the second and third ports of the first four-way valve being communicated with the inlet of the compressor;

a second four-way valve defining first to fourth ports, the second and third ports of the second four-way valve being communicated with the inlet of the compressor;

an outdoor heat exchanger defining first and second refrigerant ports, the first refrigerant port being communicated with the fourth port of the first four-way valve;

a liquid pipe defining a first end and a second end, the first end of the liquid pipe being connected with the second refrigerant port of the outdoor heat exchanger;

a first gas pipe defining a first end and a second end, the first end of the first gas pipe being connected with the second and third ports of the first four-way valve, the second and third ports of the second four-way valve, and the inlet of the compressor;

a second gas pipe defining a first end and a second end, the first end of the second gas pipe being connected with the fourth port of the second four-way valve;

a third gas pipe defining a first end and a second end, the first end of the third gas pipe being connected with the outlet of the compressor, and the second end of the third gas pipe being connected with the first port of the second four-way valve;

first and second control valves connected with each other in parallel and disposed on the second gas pipe.

2. The outdoor unit of claim 1, wherein the first port of the first four-way valve is communicated with the outlet of the compressor via a first communicating pipe, and the first end of the third gas pipe is connected with the first communicating pipe, wherein the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

3. The outdoor unit of claim 2, wherein the second port of the first four-way valve is connected with the second communicating pipe via a first capillary, and the second port of the second four-way valve is connected with the third communicating pipe via a second capillary.

4. The outdoor unit of claim 1, wherein the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve.

5. The outdoor unit of claim 1, further comprising an expansion valve connected between the second refrigerant port of the outdoor heat exchanger and the first end of the liquid pipe.

6. The outdoor unit of claim 1, wherein there are a plurality of the outdoor heat exchangers, and the number of the outdoor heat exchangers is equal to that of the first four-way valves, the first ports of the first four-way valves are connected with the outlet of the compressor and the first end of the third gas pipe respectively, the first end of the first gas pipe is connected with the second and third ports of the first four-way valves, the fourth ports of the first four-way valves are connected with the first refrigerant ports of the outdoor heat exchangers in a one-to-one correspondence manner, the first end of the liquid pipe is connected with the second refrigerant ports of the outdoor heat exchangers.

7. The outdoor unit of claim 1, further comprising:

a first switch disposed at the second end of the liquid pipe;

a second switch disposed at the second end of the second gas pipe;

a third switch disposed at the second end of the first gas pipe.

8. The outdoor unit of claim 7, wherein each of the first to third switches is any one of a cut-off valve and an electromagnetic valve.

9. A two-pipe air-conditioning system, comprising:

an indoor unit assembly comprising at least one indoor unit defining first and second refrigerant ports; and an outdoor unit comprising:

a compressor defining an outlet and an inlet;

a first four-way valve defining first to fourth ports, the first port of the first four-way valve being communicated with the outlet of the compressor, the second and third ports of the first four-way valve being communicated with the inlet of the compressor;

a second four-way valve defining first to fourth ports, the second and third ports of the second four-way valve being communicated with the inlet of the compressor;

an outdoor heat exchanger defining first and second refrigerant ports, the first refrigerant port being communicated with the fourth port of the first four-way valve;

a liquid pipe defining a first end and a second end, the first end of the liquid pipe being connected with the second refrigerant port of the outdoor heat exchanger, and the second end of the liquid pipe being connected with the first refrigerant port of the indoor unit;

a first gas pipe defining a first end and a second end, the first end of the first gas pipe being connected with the second and third ports of the first four-way valve, the second and third ports of the second four-way valve, and the inlet of the compressor;

a second gas pipe defining a first end and a second end, the first end of the second gas pipe being connected with the fourth port of the second four-way valve, and the second end of the second gas pipe being connected with the second refrigerant port of the indoor unit;

a third gas pipe defining a first end and a second end, the first end of the third gas pipe being connected with the outlet of the compressor, and the second end of the third gas pipe being connected with the first port of the second four-way valve;

first and second control valves connected with each other in parallel and disposed on the second gas pipe.

10. The two-pipe air-conditioning system according to claim 9, wherein the first port of the first four-way valve is communicated with the outlet of the compressor via a first communicating pipe, and the first end of the third gas pipe is connected with the first communicating pipe, wherein the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

11. The two-pipe air-conditioning system according to claim 10, wherein there are a plurality of the outdoor heat exchangers, and the number of the outdoor heat exchangers is equal to that of the first four-way valves, the first ports of the first four-way valves are connected with the outlet of the compressor and the first end of the third gas pipe respectively, the first end of the first gas pipe is connected with the second and third ports of the first four-way valves, the fourth ports of the first four-way valves are connected with the first refrigerant ports of the outdoor heat exchangers in a one-to-one correspondence manner, the first end of the liquid pipe is connected with the second refrigerant ports of the outdoor heat exchangers.

12. The two-pipe air-conditioning system according to claim 10, wherein the outdoor unit further comprises:

a first switch disposed at the second end of the liquid pipe;

a second switch disposed at the second end of the second gas pipe;

a third switch disposed at the second end of the first gas pipe.

13. The outdoor unit according to claim 12, wherein each of the first to the third switches is any one of a cut-off valve and an electromagnetic valve, wherein the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve.

14. A three-pipe air-conditioning system, comprising:

a first indoor unit assembly comprising at least one first indoor unit defining first and second refrigerant ports;

a second indoor unit assembly comprising at least one second indoor unit defining first and second refrigerant ports; and an outdoor unit comprising:

a compressor defining an outlet and an inlet;

a first four-way valve defining first to fourth ports, the first port of the first four-way valve being communicated with the outlet of the compressor, the second and third ports of the first four-way valve being communicated with the inlet of the compressor;

a second four-way valve defining first to fourth ports, the second and third ports of the second four-way valve being communicated with the inlet of the compressor;

an outdoor heat exchanger defining first and second refrigerant ports, the first refrigerant port being communicated with the fourth port of the first four-way valve;

a liquid pipe defining a first end and a second end, the first end of the liquid pipe being connected with the second refrigerant port of the outdoor heat exchanger, and the second end of the liquid pipe being connected with the first refrigerant ports of the first and second indoor units;

a first gas pipe defining a first end and a second end, the first end of the first gas pipe being connected with the second and third ports of the first four-way valve, the second and third ports of the second four-way valve, and the inlet of the compressor;

a second gas pipe defining a first end and a second end, the first end of the second gas pipe being connected with the fourth port of the second four-way valve;

a third gas pipe defining a first end and a second end, the first end of the third gas pipe being connected with the outlet of the compressor, and the second end of the third gas pipe being connected with the first port of the second four-way valve;

first and second control valves connected with each other in parallel and disposed on the second gas pipe; and a refrigerant switching device connected with the second refrigerant ports of the first and second indoor units and the second end of the first gas pipe, and configured to switch a flowing direction of the refrigerant.

15. The three-pipe air-conditioning system according to claim 14, wherein the refrigerant switching device comprises a first direction switching member and a second direction switching member, each of the first and second direction switching members has first to third ports, wherein the first port of the first direction switching member is connected with the second refrigerant port of the first indoor unit, the first port of the second direction switching member is connected with the second refrigerant port of the second indoor unit, and the second ports of the first and second direction switching members are connected in parallel and then connected with the second end of the first gas pipe, and the third ports of the first and second direction switching members are connected in parallel and then connected with the second end of the second gas pipe.

16. The three-pipe air-conditioning system according to claim 15, wherein each of the first and second direction switching members comprises:

a first valve connected between the first and second ports of each of first and second direction switching members;

a second valve connected in parallel with the first valve;

a third valve connected between the first and third ports of each of first and second direction switching members;

a fourth valve connected in parallel with the third valve.

17. The three-pipe air-conditioning system according to claim 16, wherein each of the first to fourth valves is any one of an electronic expansion valve, a four-way valve and an electromagnetic valve.

18. The three-pipe air-conditioning system according to claim 14, wherein the first port of the first four-way valve is connected with the outlet of the compressor via a first communicating pipe, the first end of the third gas pipe is connected with the first communicating pipe, wherein the first end of the first gas pipe is connected with the second and third ports of the first four-way valve via a second communicating pipe, the third port of the second four-way valve is connected with the first end of the first gas pipe via a third communicating pipe, and the second port of the second four-way valve is connected with the third communicating pipe.

19. The three-pipe air-conditioning system according to claim 18, wherein there are a plurality of the outdoor heat exchangers, and the number of the outdoor heat exchangers is equal to that of the first four-way valves, the first ports of the first four-way valves are connected with the outlet of the compressor and the first end of the third gas pipe respectively, the first end of the first gas pipe is connected with the second ports and the third ports of the plurality of first four-way valves, the fourth ports of the first four-way valves are connected with the first refrigerant ports of the plurality of outdoor heat exchangers in a one to one correspondence manner, the first end of the liquid pipe is connected with the second refrigerant ports of the outdoor heat exchangers.

20. The three-pipe air-conditioning system according to claim 14, wherein the outdoor unit further comprises:

a first switch disposed at the second end of the liquid pipe;

a second switch disposed at the second end of the second gas pipe;

a third switch disposed at the second end of the first gas pipe, wherein each of the first to third switches is one of a cut-off valve and an electromagnetic valve, wherein the first control valve is a check valve allowing flowing through of a refrigerant along a direction from the first end of the second gas pipe to the second end of the second gas pipe, and the second control valve is any one of a ball valve, an electromagnetic valve, an electronic expansion valve and a cut-off valve.

* * * * *